US010584450B2

(12) United States Patent
Schlenker

(10) Patent No.: US 10,584,450 B2
(45) Date of Patent: Mar. 10, 2020

(54) ROTARY MIXER

(71) Applicant: Caterpillar Paving Products Inc., Brooklyn Park, MN (US)

(72) Inventor: Brian Joe Schlenker, Shoreview, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 163 days.

(21) Appl. No.: 15/467,833

(22) Filed: Mar. 23, 2017

(65) Prior Publication Data

US 2018/0274184 A1 Sep. 27, 2018

(51) Int. Cl.
*E01C 23/12* (2006.01)
*E01C 23/06* (2006.01)

(52) U.S. Cl.
CPC ..... *E01C 23/065* (2013.01)

(58) Field of Classification Search
CPC .... E01C 19/1054; E01C 23/12; E01C 23/065; E21C 23/088; E21C 23/127; E21C 25/10
USPC ..... 404/92; 299/39.4
See application file for complete search history.

(56) References Cited

U.S. PATENT DOCUMENTS 2,046,417 A * 7/1936 Talbot ..... E01C 19/1054 404/92
2,067,236 A * 1/1937 Hepburn ..... E01C 19/1054 404/92
4,335,974 A * 6/1982 Wirtgen ..... E01C 23/065 404/101
4,637,753 A * 1/1987 Swisher, Jr. ..... E01C 23/065 172/112
4,704,045 A * 11/1987 Taylor ..... E01C 23/088 172/112
4,878,759 A * 11/1989 Tomlinson ..... B01F 9/0007 366/56
4,971,476 A * 11/1990 Guillon ..... E01C 19/025 404/91
5,373,902 A 12/1994 Lindblom
5,722,789 A * 3/1998 Murray ..... B28D 1/18 299/39.4
5,893,677 A * 4/1999 Haehn ..... E01C 23/088 299/39.4
6,116,699 A * 9/2000 Kaczmarski ..... E01C 23/088 299/36.1
6,135,567 A * 10/2000 Cochran ..... B27B 9/02 125/13.01

(Continued)

*Primary Examiner* — Thomas B Will
*Assistant Examiner* — Katherine J Chu
(74) *Attorney, Agent, or Firm* — Schwegman, Lundberg & Woessner

(57) ABSTRACT

Disclosed is a rotary mixer and method of operating such. The rotary mixer may comprise a frame, an arm pivotally connected to the frame, a mixing chamber, a cantilevered rotor and a gearbox. The mixing chamber includes a first sidewall and a second sidewall. The cantilevered rotor is disposed inside the mixing chamber and has a supported end adjacent to the first sidewall and a free end adjacent to the second sidewall. The cantilevered rotor is operably connected at the supported end to the arm. The cantilevered rotor includes a shell and a plurality of work tools mounted thereon. The shell extends from a first cutting edge to a second cutting edge. The second cutting edge is adjacent to the second sidewall. The gearbox extends through the first sidewall and into the supported end of the cantilevered rotor.

12 Claims, 3 Drawing Sheets

(56) References Cited

U.S. PATENT DOCUMENTS

| | | | | |
|---|---|---|---|---|
| 6,315,365 | B1 * | 11/2001 | Gerer | E21C 25/10 299/101 |
| 7,082,743 | B1 * | 8/2006 | Erickson | A01B 33/021 56/249 |
| 7,837,276 | B2 * | 11/2010 | Kraemer | E01C 23/088 299/39.6 |
| 7,918,512 | B2 | 4/2011 | Mannebach et al. | |
| 7,976,239 | B2 * | 7/2011 | Hall | E01C 23/088 299/39.4 |
| 8,177,456 | B2 * | 5/2012 | Haroldsen | E01C 23/088 299/39.2 |
| 8,474,919 | B2 * | 7/2013 | Cipriani | E01C 23/088 299/39.4 |
| 8,794,869 | B2 | 8/2014 | Schlenker et al. | |
| 9,234,320 | B2 * | 1/2016 | Abresch | E01C 23/088 |
| 9,714,488 | B2 * | 7/2017 | Franzmann | E01C 23/088 |
| 2007/0228806 | A1 * | 10/2007 | Holl | B28D 1/186 299/39.4 |
| 2009/0051210 | A1 * | 2/2009 | Busley | E01C 21/00 299/39.4 |
| 2013/0334866 | A1 | 12/2013 | Pederson et al. | |
| 2014/0333117 | A1 * | 11/2014 | Franzmann | E01C 23/088 299/39.2 |
| 2014/0333118 | A1 | 11/2014 | Abresch et al. | |
| 2015/0117951 | A1 | 4/2015 | Schlenker et al. | |
| 2016/0024728 | A1 | 1/2016 | Menzenbach et al. | |
| 2016/0237637 | A1 | 8/2016 | Schlenker et al. | |

* cited by examiner

ROTARY MIXER

TECHNICAL FIELD

This disclosure generally relates to a rotary mixer and, more particularly, to a working section for a rotary mixer.

BACKGROUND

A rotary mixer may be used to cut, mix, and pulverize ground surfaces, such as a roadway or the like. A rotary mixer may also be used as a road reclaimer to pulverize a surface layer, such as asphalt, and can mix it with an underlying base to create a new road surface and to stabilize deteriorated roadways.

Generally speaking, a rotary mixer includes a frame supported by wheels, or endless tracks. The frame provides support for an operator station and a power source. The rotary mixer includes an open bottom mixing chamber connected to the frame. A pair of arms are pivotally attached to the frame on either side, and are attached to a rotatable drum suspended inside the mixing chamber. The rotatable drum is supported by the pivot arms. As the drum rotates, work tools disposed about its outer surface cut, mix and pulverize the ground surface. However, the work tools may not be able to reach areas near the outside edges of the ground surface, thus such areas may need to be worked by hand.

US Publication No. 2014/0333118 to Abresch et al. discloses a method for mounting a milling drum on an arm in a road milling machine for working road surfaces. The milling drum is driven by a milling drum drive, where stud bolts for mounting the milling drum project from the milling drum drive, and the stud bolts engage with cut-outs or drill holes arranged accordingly in a connecting flange of the milling drum. While beneficial a better design is needed.

SUMMARY

In accordance with one aspect of the present disclosure, a rotary mixer is disclosed. The rotary mixer may comprise a frame, an arm pivotally connected to the frame, a mixing chamber, a cantilevered rotor and a gearbox. The mixing chamber is mounted under the frame and extends laterally across the rotary mixer. The mixing chamber includes a first sidewall, a second sidewall and a hood wall disposed between the first sidewall and the second sidewall. The mixing chamber defines an open bottom. The cantilevered rotor is disposed inside the mixing chamber and has a supported end adjacent to the first sidewall and a free end adjacent to the second sidewall. The cantilevered rotor is operably connected at the supported end to the arm. The cantilevered rotor includes a shell and a plurality of work tools. The shell has an exterior surface extending from a first cutting edge to a second cutting edge. The second cutting edge is adjacent to the second sidewall. The shell is cylindrical and elongated in shape and rotatable about an axis. The plurality of work tools are mounted on the exterior surface of the shell. The gearbox extends through the first sidewall and into the supported end of the cantilevered rotor.

In accordance with another aspect of the present disclosure, method of operating a rotary mixer is disclosed. The rotary mixer includes a frame, an arm pivotally connected to the frame, a mixing chamber mounted under the frame, a cantilevered rotor, a first traction unit supporting the frame, and a second traction unit supporting the frame. The mixing chamber includes a first sidewall, a second sidewall and a hood wall disposed between the first sidewall and the second sidewall. The cantilevered rotor is disposed inside the mixing chamber and has a supported end adjacent to the first sidewall and a free end adjacent to the second sidewall. The cantilevered rotor is operably connected at the supported end to the arm. The cantilevered rotor including a shell and a plurality of work tools. The shell is cylindrical in shape and rotatable about an axis. The plurality of work tools is mounted on an exterior surface of the shell. The first traction unit is disposed proximal to the supported end and the second traction unit is disposed proximal to the free end. The method may comprise lowering the rotor until at least one work tool of the plurality of work tools engages work material; and rotating the rotor so that the plurality of work tools mix the work material, wherein at least one cutting tool mixes work material that is disposed adjacent to the second sidewall and laterally outward from the second traction unit.

In another aspect of the present disclosure, a rotary mixer is disclosed. The rotary mixer may comprise first traction unit, a second traction unit, a frame supported by the first and second traction units, an arm pivotally connected to the frame, a mixing chamber, a cantilevered rotor and a gearbox. The mixing chamber is mounted under the frame and extends laterally across the rotary mixer. The mixing chamber includes a first sidewall proximal to the first traction unit, a second sidewall proximal to the second traction unit and a hood wall disposed between the first sidewall and the second sidewall. The mixing chamber defines an open bottom. The cantilevered rotor is disposed inside the mixing chamber and has a supported end and a free end. The cantilevered rotor is operably connected to the arm at the supported end. The cantilevered rotor includes a shell and a plurality of work tools. The shell extends between a first cutting edge and a second cutting edge. The second cutting edge is adjacent to the second sidewall. The shell is elongated in shape and has an exterior surface and an inner surface and is rotatable about an axis. The plurality of work tools are mounted on the exterior surface of the shell. The gerbox extends through the first sidewall into the supported end of the cantilevered rotor. The cantilevered rotor is not connected to the second sidewall and is free of rotational support disposed at the free end.

These and other aspects and features of the present disclosure will be more readily understood when read in conjunction with the accompanying drawings.

DETAILED DESCRIPTION

Figure 1:
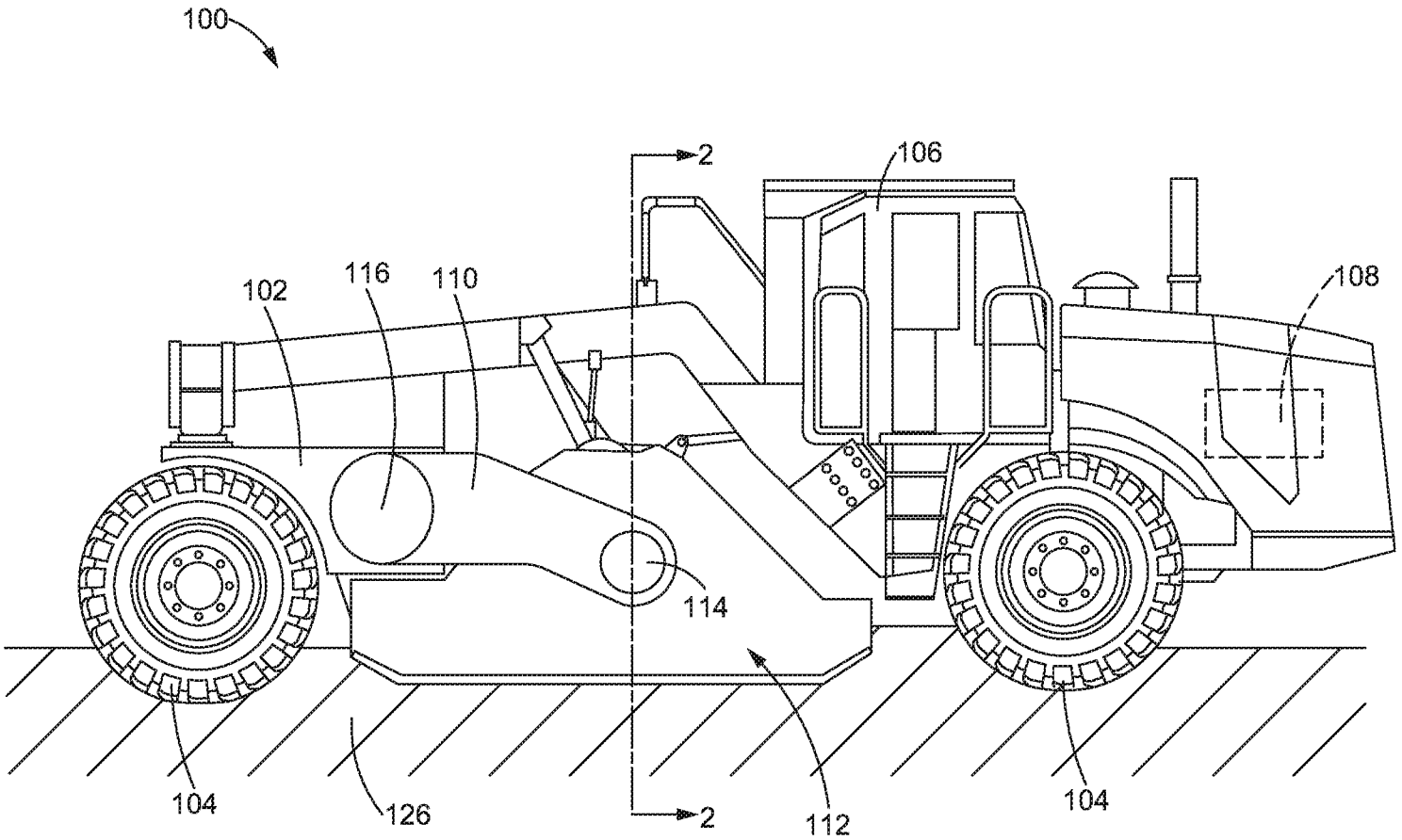
FIG. 1 is a side view of a rotary mixer in accordance with the present disclosure.

FIG. 1 illustrates on example of a rotary mixer 100 that incorporates the features of the present disclosure. The rotary mixer 100 includes a frame 102 supported by a plurality of traction units 104. In the embodiment of FIG. 1, there are two pairs of traction units 104. Although traction units 104 are depicted as wheels, it is to be understood that other devices, such as but not limited to tracks or the like, may also be employed.

The frame 102 provides support for an operator station 106 and a power source 108. A power source 108 may be configured to electrically, mechanically, hydraulically and/ or pneumatically power the traction units 104 and the cantilevered rotor 130 (discussed later herein). An arm 110 is connected to a mixing chamber 112 at a first arm end 114 and is pivotally connected to the frame 102 at a second arm end 116. The mixing chamber 112 is mounted under the frame 102 and is positioned between the traction units 104. The mixing chamber 112 extends laterally across the rotary mixer 100.

Figure 2:
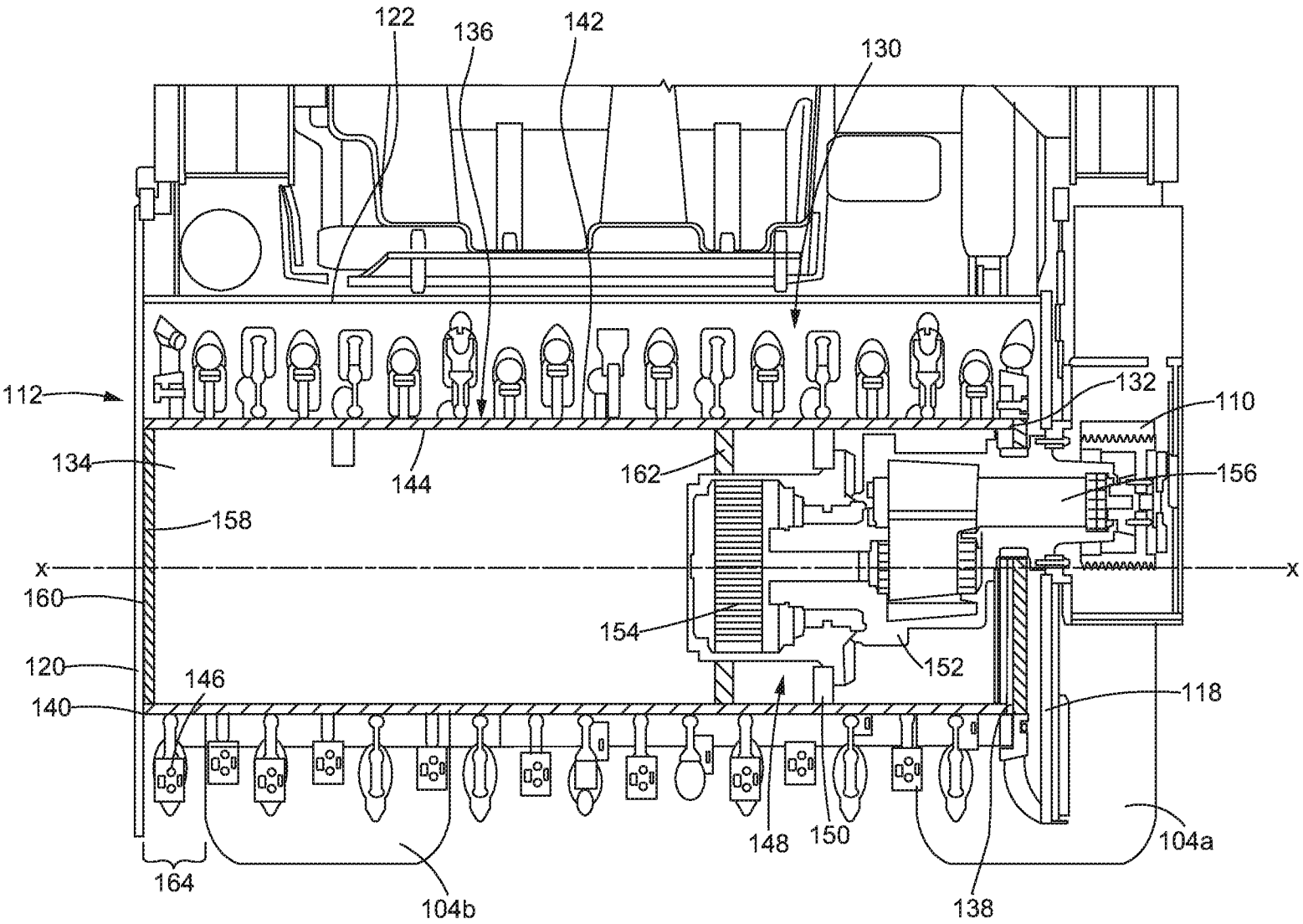
FIG. 2 is a cross-sectional view of the mixing chamber and cantilevered rotor taken along line 2-2 of FIG. 1.

FIG. 2 illustrates a cross-section of the mixing chamber 112. The mixing chamber 112 includes a first sidewall 118, a second sidewall 120 and a hood wall 122. The first sidewall 118 is proximal to the first traction unit 104*a*. The second sidewall 120 is proximal to the second traction unit 104*b*. The hood wall 122 is disposed between the first sidewall 118 and the second sidewall 120. More specifically, the hood wall 122 extends from the first sidewall 118 to the second sidewall 120. The mixing chamber 112 defines an open bottom 124 (see FIG. 3) that faces the ground surface 126 or work material 128.

The rotary mixer 100 further includes a cantilevered rotor 130 disposed inside the mixing chamber 112. The cantilevered rotor 130 is mounted inside the mixing chamber 112 to have a supported end 132 and a free end 134. By free end, it is meant that there is no structure connected to that end of the cantilevered rotor 130 that provides rotational or weight support for the cantilevered rotor 130, or that is connected to that end to position the cantilevered rotor 130 within the mixing chamber 112. The cantilevered rotor 130 is operably connected to the arm 110 at the supported end 132. The cantilevered rotor 130 is configured to cut, mix and/or pulverize a work material 128 of a ground surface 126 on which the rotary mixer 100 is operating. The work material 128 may include any material such as soil, dirt, gravel, sand, stones, concrete, pavement and the like.

The cantilevered rotor 130 includes a shell 136 that extends between a first cutting edge 138 and a second cutting edge 140 of the cantilevered rotor 130. The second cutting edge 140 is disposed adjacent to the second sidewall 120. The shell 136 is cylindrical and elongated in shape, and has an exterior surface 142 and an inner surface 144. The shell 136 rotatable about an axis X.

The cantilevered rotor 130 further includes a plurality of work tools 146 mounted on the exterior surface 142 of the shell 136. A section 164 of the shell 136 is disposed adjacent to the second sidewall 120 and laterally outward of the traction unit 104*b* proximal to the second sidewall 120. One or more work tools 146 are disposed on this section 164 of the shell 136.

The cantilevered rotor 130 further includes a gearbox 148 and a first flange 150. The gearbox 148 is disposed proximal to the supported end 132 and distal from the free end 134. The gearbox 148 extends through the first sidewall 118 and into the supported end 132 of the cantilevered rotor 130, and is operably connected to the arm 110. The structure of the gearbox 148 supports the cantilevered rotor 130. The gearbox 148 includes a drive section 152 and a driven section 154. The driven section 154 is operably connected to the arm 110. The first flange 150 may be disposed to extend radially inward from the inner surface 144 of the shell 136 toward the axis X. The first flange 150 is connected to the driven section 154 of the gearbox 148.

The cantilevered rotor 130 may further include an end cap 158 mounted on the shell 136 at the free end 134. The end cap 158 is disposed adjacent to the second sidewall 120. In an embodiment, the end cap 158 may cover the free end 134 of the shell 136 and, in some embodiments, may be free of apertures or the like. A gap 160 is sandwiched between the second sidewall 120 and the end cap 158. The end cap 158 borders the second sidewall 120 but is not in contact with the second sidewall 120 because of the gap 160. The gap 160 may be filled with air or lubricant or the like. The gap 160 is narrow and free of structure that supports the cantilevered rotor 130, unlike traditional arrangements of components in the mixing chamber 112.

In some embodiments, although not all embodiments, the cantilevered rotor 130 may further include a second flange 162 that extends radially inward from the inner surface 144 of the shell 136 toward the axis. The second flange 162 may be disposed between the first flange 150 and the second cutting edge 140. The second flange 162 may be connected to the driven section 154 of the gearbox 148.

The rotary mixer 100 further includes a drive shaft 156. The drive shaft 156 is disposed internal to the gearbox 148. The drive shaft 156 is operably connected to the drive section 152 of the gearbox 148 and to a motor (not shown). The motor, drive shaft 156 and gearbox 148 are configured to rotate the cantilevered rotor 130.

The cantilevered rotor 130 is supported at the supported end 132 by the gearbox 148. The cantilevered rotor 130 is not connected to the second sidewall 120 and is free of rotational support disposed at the free end 134. Explained another way, the entire cantilevered rotor 130 is supported by structure only at one end, the supported end 132. The rotational support structure(s) (e.g. shafts, hubs or the like) typically disposed at the end of a rotor and extending through the second sidewall 120 are not used in the present disclosure to position, rotate or support (the weight of) the cantilevered rotor 130 in the mixing chamber 112. As can be seen in FIG. 2, there is no rotational support structure connected to the cantilevered rotor 130 at the free end 134 to position, rotate or support (the weight) of the cantilevered rotor 130. As such, the position, rotation and weight support for the entire cantilevered rotor 130 is provided at only one end, the supported end 132.

INDUSTRIAL APPLICABILITY

The present disclosure can find application in road construction or the like. Soil stabilization of a ground surface 126 is often required before any road or building construction on the ground surface 126 may proceed. The present disclosure improves upon existing soil stabilization processes with regard to more efficiently mixing work material 128 in a ground surface 126.

Figure 3:
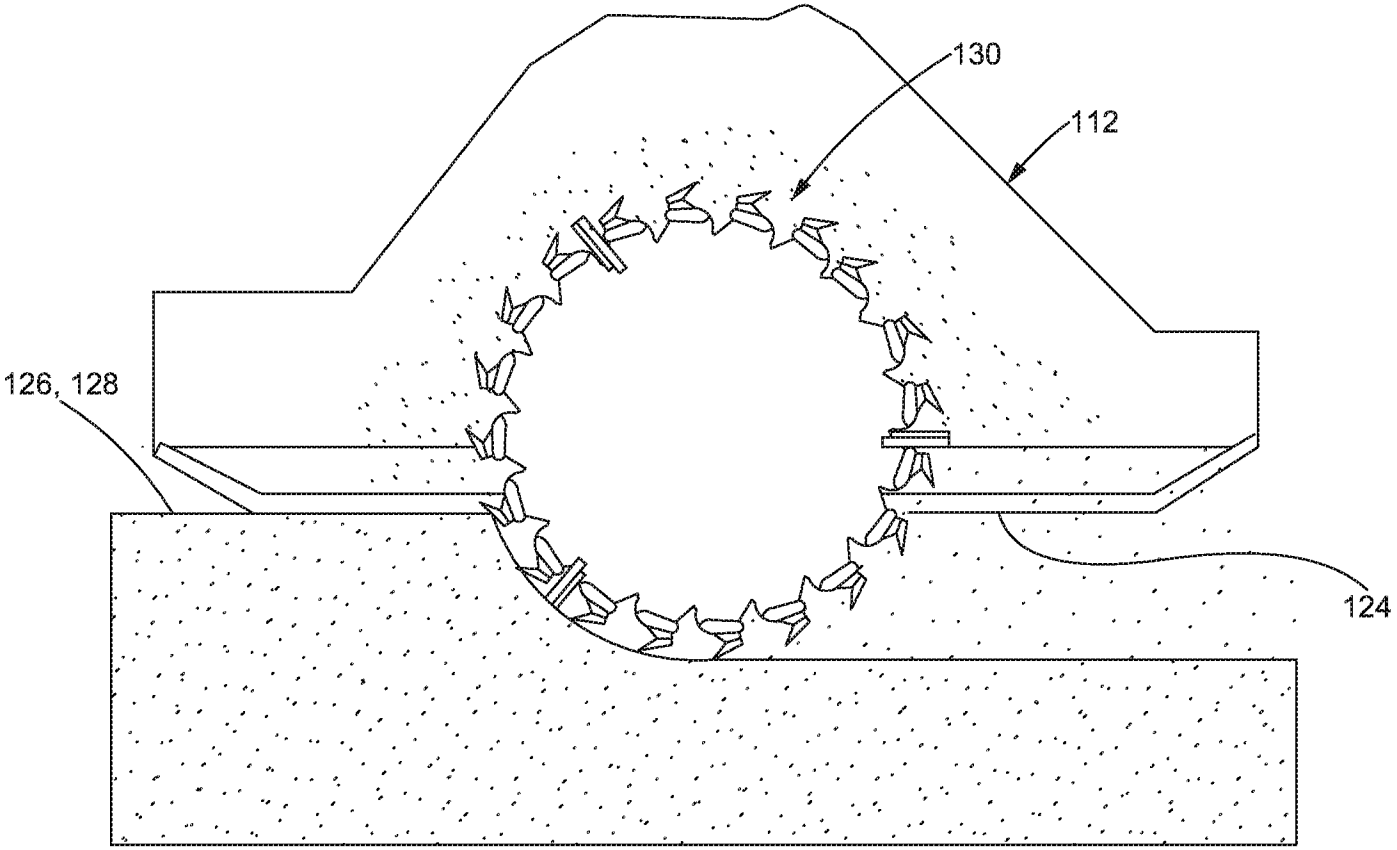
FIG. 3 is a side view of a working section of the rotary mixer in with a first sidewall and gearbox removed.

In operation, the rotary mixer 100 lowers the rotor until at least one work tool 146 of the plurality of work tools 146 engages work material 128 or the ground surface 126. The cantilevered rotor 130 is then rotated and the tip ends of each work tool 146 is driven into the work material 128 by the rotation of the cantilevered rotor 130. The plurality of work tools 146 mix the work material 128. As the rotary mixer 100 advances along the ground surface 126, the cantilevered rotor 130 and work tools 146 penetrate the ground surface 126 and lift the work material 128 causing the work material 128 to move upwards into the mixing chamber 112, as indicated in FIG. 3.

Typically, rotary mixers 100 support the rotor at both lateral ends. The structure required to do this increases the distance between the sidewall of the mixing chamber 112 and the outer cutting edge of the the shell 136, which increases the distance between the sidewall and the laterally outermost work tool 146 (mounted on the shell 136). This typically means that a strip of material at the edge of a ground surface 126, such as a roadway, cannot be reached by the work tool 146 for mixing. This unmixed strip must then be worked (mixed) manually.

In the present disclosure, the distance from the second cutting edge 140 to the second sidewall 120 is minimized by the cantilevered rotor 130 that eliminates the typical support and rotational structure from one end of the rotor. Moreover, by disposing the second cutting edge 140 adjacent to the second sidewall 120, separated by a narrow gap 160, a section 164 of the shell 136, and the working tools 146 thereon, are disposed adjacent to the second sidewall 120 and laterally outward from the second traction unit 104*b*. This minimizes, or almost eliminates, the strip of unmixed ground surface 126 found at the edge of the roadway after a rotary mixer operation.

Also disclosed is a method of operating the rotary mixer 100. The method comprising lowering the rotor until at least one work tool 146 of the plurality of work tools 146 engages work material 128; and rotating the rotor so that the plurality of work tools 146 mix the work material 128, wherein at least one cutting tool mixes work material 128 that is disposed adjacent to the second sidewall 120 and laterally outward from the second traction unit 104*b*.

The above description is meant to be representative only, and thus modifications may be made to the embodiments described herein without departing from the scope of the disclosure. Thus, these modifications fall within the scope of present disclosure and are intended to fall within the appended claims.

What is claimed is:

1. A rotary mixer comprising:

a frame:

an arm pivotally connected to the frame; and a mixing chamber mounted under the frame and extending laterally across the rotary mixer, the mixing chamber including a first sidewall, a second sidewall and a hood wall disposed between the first sidewall and the second sidewall, wherein the mixing chamber defines an open bottom;

a cantilevered rotor disposed inside the mixing chamber and having a supported end adjacent to the first sidewall and a free end adjacent to the second sidewall, the cantilevered rotor operably connected at the supported end to the arm, the cantilevered rotor including:

a shell having an exterior surface extending from a first cutting edge to a second cutting edge, the second cutting edge adjacent to the second sidewall, the shell cylindrical and elongated in shape and rotatable about an axis; and a plurality of work tools mounted on the exterior surface of the shell;

a gearbox extending through the first sidewall into the supported end of the cantilevered rotor, wherein the gearbox is disposed proximal to the supported end and distal from the free end and is configured to support the shell in a cantilevered manner, the gearbox having a drive section and a driven section;

a first flange extending radially inward from an inner surface of the shell toward the axis, the first flange connected to the driven section of the gearbox;

a second flange extending radially inward from the inner surface of the shell toward the axis, the second flange disposed between the first flange and the second cutting edge, wherein the second flange is connected to the driven section of the gearbox; and a first traction unit and a second traction unit, each supporting the frame, the first traction unit disposed proximal to the supported end and the second traction unit disposed proximal to the free end, wherein a section of the shell is disposed adjacent to the second sidewall and laterally outward of the second traction unit, wherein at least one tool is disposed on the section of the shell.

2. The rotary mixer according to claim 1, wherein the driven section of the gearbox is operably connected to the arm.

3. The rotary mixer according to claim 2, in which the cantilevered rotor further includes an end cap mounted on the shell at the free end, the end cap disposed adjacent to the second sidewall.

4. The rotary mixer according to claim 3, wherein a gap is sandwiched between the second sidewall and the end cap, the gap is free of structure that supports the cantilevered rotor.

5. A method of operating a rotary mixer, the rotary mixer including a frame, an arm pivotally connected to the frame, a mixing chamber mounted under the frame, the mixing chamber including a first sidewall, a second sidewall and a hood wall disposed between the first sidewall and the second sidewall, a cantilevered rotor disposed inside the mixing chamber and having a supported end adjacent to the first sidewall and a free end adjacent to the second sidewall, the cantilevered rotor operably connected at the supported end to the arm, the cantilevered rotor including a shell and a plurality of work tools, the shell being cylindrical in shape and rotatable about an axis, the plurality of tools mounted on an exterior surface of the shell, a first traction unit supporting the frame and a second traction unit supporting the frame, the first traction unit disposed proximal to the supported end and the second traction unit disposed proximal to the free end, a gearbox disposed in the shell, wherein the gearbox is disposed proximal to the supported end and distal from the free end, and is configured to support the shell in a cantilevered manner, the gearbox having a drive section and a driven section, a first flange extending radially inward from an inner surface of the shell toward the axis, the first flange connected to the driven section of the gearbox, a second flange extending radially inward from the inner surface of the shell toward the axis, the second flange disposed between the first flange and the second cutting edge, wherein the second flange is connected to the driven section of the gearbox; the method comprising:

lowering the rotor until at least one work tool of the plurality of work tools engages work material; and rotating the rotor so that the plurality of work tools mix the work material, wherein at least one cutting tool mixes work material that is disposed adjacent to the second sidewall and laterally outward from the second traction unit.

6. The method of claim 5, further comprising moving the rotary mixer forward during the rotating.

7. The method of claim 5, in which the cantilevered rotor further includes an end cap mounted on the shell at the free end.

8. The method of claim 7, wherein an air gap is sandwiched between the second sidewall and the end cap.

9. A rotary mixer, comprising:

a first traction unit;

a second traction unit;

a frame supported by the first and second traction units;

an arm pivotally connected to the frame;

a mixing chamber mounted under the frame and extending laterally across the rotary mixer, the mixing chamber including a first sidewall proximal to the first traction unit, a second sidewall proximal to the second traction unit and a hood wail disposed between the first sidewall and the second sidewall, wherein the mixing chamber defines an open bottom;

a cantilevered rotor disposed inside the mixing chamber and having a supported end and a free end, the cantilevered rotor operably connected to the arm at the supported end, the cantilevered rotor including:

a shell extending between a first cutting edge and a second cutting edge, the second cutting edge adjacent to the second sidewall, the shell elongated in shape and having an exterior surface and an inner surface, the shell rotatable about an axis;

a plurality of work tools mounted on the exterior surface of the shell;

a gearbox extending through the first sidewall into the supported end of the cantilevered rotor, wherein the gearbox is configured to support the shell in a cantilevered manner such that the cantilevered rotor is disposed proximal to the supported end and distal from the free end and is not connected to the second sidewall and is free of rotational support disposed at the free end, the gearbox having a drive section and a driven section;

a first flange extending radially inward from an inner surface of the shell toward the axis, the first flange connected to the drive section of the gearbox;

a second flange extending radially inward from the inner surface of the shell toward the axis, the second flange disposed between the first flange and the second cutting edge, wherein the second flange is connected to the driven section of the gearbox; and wherein a section of the shell is disposed adjacent to the second sidewall and laterally outward of the second traction unit, and wherein at least one tool is disposed on the section.

10. The rotary mixer according to claim 9, wherein the driven section of the gearbox is operably connected to the arm.

11. The rotary mixer according to claim 9, in which the cantilevered rotor further includes an end cap mounted on the shell at the free end, the end cap disposed adjacent to the second sidewall.

12. The rotary mixer according to claim 11, wherein an air gap is sandwiched between the second sidewall and the end cap.

* * * * *